United States Patent [19]

Rasmussen et al.

[11] 4,369,926

[45] Jan. 25, 1983

[54] METHOD AND APPARATUS FOR GRINDING GRANULAR MATERIALS

[75] Inventors: Ole S. Rasmussen; Peter Lund, both of Copenhagen, Denmark

[73] Assignee: F. L. Smidth & Co., Cresskill, N.J.

[21] Appl. No.: 107,846

[22] Filed: Dec. 28, 1979

[30] Foreign Application Priority Data

Dec. 29, 1978 [GB] United Kingdom ..... 50281/78

[51] Int. Cl.[3] ..... B02C 17/06

[52] U.S. Cl. ..... 241/18; 241/24; 241/29; 241/30; 241/65; 241/72; 241/76; 241/153; 241/171; 241/181; 241/80; 241/97; 241/184

[58] Field of Search ..... 241/23, 24, 29, 30, 241/65, 70, 71, 72, 76, 78, 79, 80, 79.1, 79.3, 81, 97, 153, 170, 176, 179, 180, 26, 184, 171, 181, 18

[56] References Cited

U.S. PATENT DOCUMENTS

| | | | |
|---|---|---|---|
| 1,217,351 | 2/1917 | Schwarz | 241/72 X |
| 1,748,920 | 2/1930 | Newhouse | 241/72 X |
| 2,160,169 | 5/1939 | Pontoppidan | 241/72 |
| 3,144,212 | 8/1964 | Klovers | 241/72 X |
| 3,529,781 | 9/1970 | Hastrup | 241/181 |
| 3,718,286 | 2/1973 | Fagerholt | 241/70 X |
| 3,877,650 | 4/1955 | Cornford | 241/72 X |
| 4,083,500 | 4/1978 | Kartman | 241/72 X |

FOREIGN PATENT DOCUMENTS

| | | |
|---|---|---|
| 427127 | 5/1945 | Canada . |
| 653193 | 11/1962 | Canada . |

*Primary Examiner*—Mark Rosenbaum
*Attorney, Agent, or Firm*—Pennie & Edmonds

[57] ABSTRACT

The invention relates to a method of and apparatus for dry grinding a granular material in a grinding tube mill (1) having a final grinding compartment (2) and one or more preceding grinding compartments (3) containing grinding bodies. The material, after having passed through the preceding compartment or compartments (3), is discharged through openings (6) in the mill (1) and is divided into a fine and a coarse fraction in a separator (9). The coarse fraction is returned to the preceding compartment or compartments (3), and the fine fraction is fed to the final compartment (2). The ground material is discharged by flowing over a dam ring (12) from the final compartment (2). Any grinding bodies carried with the overflow are separated by a sieving diaphragm (13) from the material and returned to the final compartment (2). The invention also relates to the granular material ground according to the method of the invention.

29 Claims, 11 Drawing Figures

METHOD AND APPARATUS FOR GRINDING GRANULAR MATERIALS

TECHNICAL FIELD

This invention relates to a method and an apparatus for dry grinding a granular material. The method is carried out in a tube mill having a final and one or more preceding grinding compartments containing grinding bodies in which the material, after having passed through the preceding compartment or compartments, is discharged through openings in the mill and is divided into a fine and a coarse fraction by a separation process from which the coarse fraction is returned to the preceding compartment or compartments, and the fine fraction is fed to the final compartment.

BACKGROUND ART

In known processes of the type contemplated in the present invention, granular material is admitted into a tube mill and is ground and passed through different compartments. After passing through the tube mill the material is discharged from the mill. The grinding in the final compartment takes place with the assistance of grinding bodies having an average piece weight between 20 and 40 grams (g). The minimum size is typically about 20 millimeters (mm). As a result of the free flow area required together with the strength and manufacturing requirements, small grinding bodies are not used since the slots in conventional outlet diaphragms used in the final compartment cannot be constructed sufficiently narrow so as to allow the use of smaller grinding bodies and ensure effective screening of the ground material.

Although it has been widely recognized that in order to achieve optimum grinding economy, the size of grinding bodies used in the final grinding compartment of a mill should be far smaller than that presently in use, up until the present no method or apparatus has been devised in which such smaller grinding bodies may be used.

We have invented a grinding method and apparatus according to which optimum grinding economy is achieved in a tube mill having two or more compartments. According to a significant feature of our invention, the tube mill utilizes grinding bodies which are particularly dimensioned in accordance with the size of the particles of materials required in the final product.

DISCLOSURE OF THE INVENTION

According to the present invention, a grinding method and apparatus are directed to achieving optimum grinding economy in a tube mill having two or more compartments by an arrangement which makes it possible to utilize grinding bodies of a size which is particularly related to the size of material required in the final product, preferably a very small size which produces a fine ground finished product.

The present invention relates to a method of dry grinding a granular material in a grinding tube mill having a final and one or more preceding grinding compartments containing grinding bodies. The material, after having passed through the preceding compartment or compartments, is discharged through openings in the mill and is divided into a fine and a coarse fraction by a separation process. The coarse fraction is returned to the preceding compartment or compartments, and the fine fraction being fed to the final compartment. The ground material is discharged from the final compartment and grinding bodies carried with the material are separated from the material and returned to the final compartment.

In particular, the present invention is directed to a method of dry grinding granular material to a finished ground material in a grinding tube mill. The tube mill has at least one opening, a final grinding compartment and at least one preceding grinding compartment containing grinding bodies. At least the preceding grinding compartment has an outlet sieving diaphragm. The method comprises the steps of passing the material through the preceding compartment or compartments, discharging the preground material through the openings in the tube mill, dividing the material into predetermined fine and coarse fractions, returning the coarse fraction to said at least one preceding compartment, feeding the fine fraction to the final compartment, discharging the ground material overflowing from the final compartment, separating the grinding bodies carried with the overflowing ground material and returning the grinding bodies to the final compartment.

Thus the material fed to the final grinding compartment does not contain particles of material larger than the small grinding bodies can grind, and also the grinding bodies are prevented from leaving the mill together with the ground material without the risk that they may clog the outlet from the compartment. This can be achieved even when grinding bodies having an average piece weight about 1 gram are used. The maximum size of the particles to be ground by these bodies are 1 millimeter.

Tests have shown that, in grinding cement, an economy of more than 14% can be achieved over long periods compared with conventional cement mill grinding to the same Blaine surface. The cement ground according to the present invention showed strengths superior to those of cement ground in conventional mills. These improved strengths are due to the steeper granulimetric analysis curves of the ground cement which can be attained and which, as experience shows, means improved strengths of cement ground to the same Blaine surface. This is an important advantage resulting from the use of small grinding bodies. Similar tests in which cement was ground to the same degree of strength development as conventionally ground cement showed improvements in grinding economy up to 27%.

Preferably, the separation of the material discharged from the preceding compartment or compartments is effected at such a particle size that the fine fraction from this separation fed to the final grinding compartment is finished ground in one passage through this compartment.

Preferably, the material is ground in a preceding and/or the final compartment by means of grinding bodies having an average piece weight below 10 grams, and preferably about 5 grams. The maximum size of the feed to the preceding and/or final compartment is equal to or below the width of the openings in the outlet sieve diaphragm of the respective compartment. In this case it is a question of using the optimum size of grinding bodies in a compartment for pregrinding the material. This measure contributes to the improvement of the grinding economy inasmuch as the initial coarse grinding is usually accomplished with grinding bodies having an average piece weight of about 1500 grams and which have an inferior grinding economy. Thus the grinding compartment used for this initial grinding can now be shortened in length.

In certain cases, e.g., when grinding cement, it is preferable that the fine fraction be cooled before being fed to the final grinding compartment.

In other cases, when grinding moist material, for example, cement raw materials, it is desirable that drying of the material take place simultaneously with the grinding and/or separation of the material by means of hot gases brought into contact with the material.

In one exemplary embodiment, the material discharged from the preceding compartment or compartments is deprived of any already finished ground material before being subjected to the separation.

Finally, it may also be useful to connect the final compartment to separator means including at least one or more cyclone separators, the separator being in a closed circuit arrangement therewith for precipating finished ground material. In this case part of the material may pass through the final compartment several times before it is finished ground.

The invention also relates to an apparatus for dry grinding granular material comprising a grinding tube mill divided into a final and one or more preceding grinding compartments containing grinding bodies. The mill is provided with openings through which material may be discharged from the preceding compartment or compartments. The mill also comprises means for separating the material discharged from the mill openings into coarse and fine fractions, means to convey material discharged from the mill openings to the separator means and to convey the coarse fraction from the separator means to the feed end of the preceding compartment or compartments and the fine fraction to the feed end of the final compartment. At least one dam ring and sieving diaphragm are positioned in the outlet end portion of the final compartment. The sieving diaphragm is spaced apart from the dam ring to form a chamber and defines openings smaller than the size of the grinding bodies in the final compartment. Lifting means are provided in the chamber to return to the final compartment the grinding bodies that in use, pass over the dam ring with the ground material.

In the apparatus according to the present invention, the sieving diaphragm is exposed to little wear. Therefore, it retains its original slit width and has no tendency to clog inasmuch as the dam ring relieves the pressure of the mill charge.

As a further consequence, the free passage area of the sieving diaphragm can be made considerably greater than that of a conventional diaphragm and therefore offers less resistance to the flow of material and/or air or gases.

The dam ring, which ensures the correct ratio of material and grinding bodies in the final compartment, is made of a special type of wear resistant steel to ensure long durability.

In a preferred examplary embodiment, a preceding compartment is provided at each of its inlet and outlet ends, with a dam ring and a sieving diaphragm spaced apart therefrom to form a chamber from which grinding bodies that pass over the dam ring are returned to the compartment by lifting means provided in the chamber. The diaphragms at the inlet and outlet ends have openings which are of substantially the same size. Also, these openings are smaller than the size of the grinding bodies in that compartment which have an average piece weight of less than 10 grams.

In the case of larger tube mills, for which central drives at the outlet end are preferred, it is useful to feed the material to the final compartment through openings in the mill and in such cases the final grinding compartment has a feed inlet chamber which communicates with the openings in the mill. The feed inlet chamber comprises a dam ring and lifting means for feeding the material into the compartment and for returning grinding bodies from the chamber to the compartment.

In a preferred embodiment, the inlet chamber of the final compartment comprises a dam ring and a sieving diaphragm.

In yet another examplary embodiment, the conveying means comprises means for conveying material from the outlets of both the final grinding compartment and a preceding grinding compartment to a preliminary separator for precipitating finished ground material. Further, the conveying means comprises means for conveying the non-precipitated material from the preliminary separator to a final separator which separates the material into the coarse and fine fractions.

The separator from which the fine fraction is fed to the final grinding compartment preferably is a vibratory screen. However, an air separator may also be used, for example, when simultaneously grinding and drying material. The fractioning may take place at a particle size of up to about 2 millimeters depending upon the grindability of the material to be ground.

In many cases, for example, when grinding cement, it is important to effectively cool the material being ground. This cooling may take place by means of air or atomized water brought into contact with the material during the grinding or separation of the material. An additional cooling of the material may be obtained by providing a separate cooler in the path of conveyance for the material being fed to the final grinding compartment.

In yet a further exemplary embodiment, the grinding bodies in the final grinding compartment are of an average weight of about 10 grams or less and more preferably of about 5 grams or less. The width of the openings of the diaphragm is preferably about between 2 and 5 millimeters.

In still yet another exemplary embodiment, means are provided for drying by hot gases, the material in at least one preceding grinding compartment simultaneously while being ground in that compartment.

BRIEF DESCRIPTION OF DRAWINGS

Some examples of the method and apparatus according to the present invention will now be described in detail with reference to the accompanying drawings in which.

Figure 1:
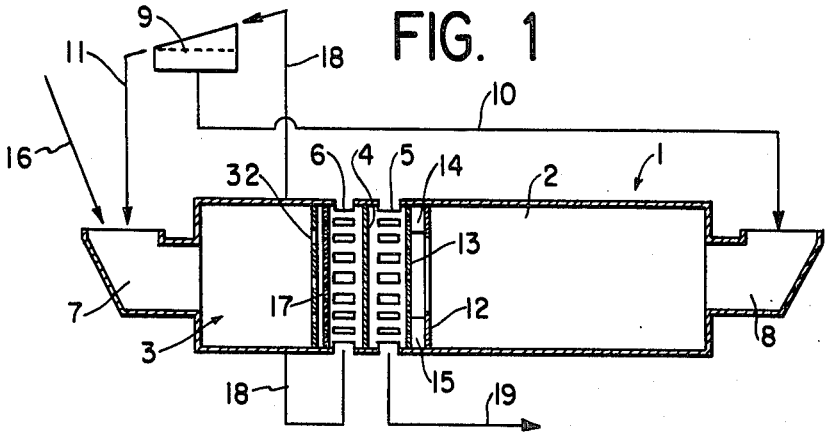
FIG. 1 is a schematic view of a preferred embodiment of the apparatus of the invention including a tube mill having one preceding and one final compartment.

material discharged from the final compartment 2 is fed to the same air separator 34 by means of a conveyor 35. The fine fraction 36 from the air separator 34 is finished ground material. The coarse fraction 37 from the air separator 34 is led to a cooler 38, of any known kind. In the cooler 38, this fraction is cooled before being fed to the inlet of the final compartment 2 as indicated by 39. The material, e.g., cement, can be cooled in all three compartments 2, 22, and 23 by means of air passed through the chambers and discharged through the openings in the mill shell. In this manner, fresh cooling air can be passed in through both ends of the mill 33 which is preferable to cooling by means of a single air stream passing through the whole length of the mill 33. Additional cooling can be provided by atomizing water into the compartments. However, due to the intense development of heat in a mill in which small grinding bodies are used to a large extent it is often useful to cool the material before it is fed to the final compartment in which there is the greatest risk of clogging the material on the grinding bodies.

Figure 4:
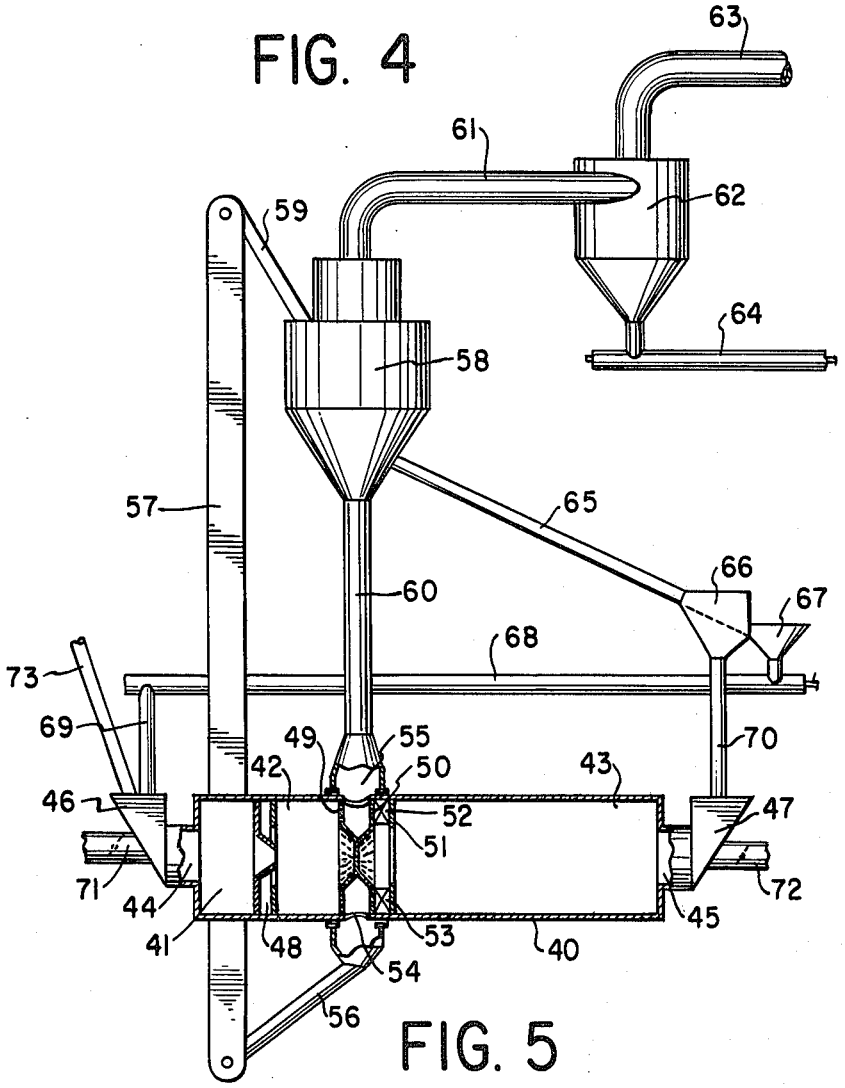
FIG. 4 is a schematic view of a fourth embodiment of the apparatus of the present invention.

FIG. 4 shows an apparatus for simultaneously grinding and drying moist material, e.g., cement raw material. The apparatus comprises a tube mill 40 having a drying compartment 41, a pregrinding compartment 42, and a final grinding compartment 43. The mill has trunnions 44 and 45 communicating with feed hoppers 46 and 47. A diaphragm 48 having means for transportation of the predried material into the compartment 42 is provided between the compartments 41 and 42. Compartment 42 has an outlet sieving diaphragm 49 constructed together with an outlet sieving diaphragm 50 for the final compartment 43. A dam ring 51 is spaced apart from the diaphragm 50 to form a chamber 52 wherein lifting members 53 are mounted. The outlet formed by the parts 50 to 53 functions in the same way as described in connection with the parts 12 to 15 of FIG. 1.

The material, having passed through the diaphragms 49 and 50, leaves the mill through openings 54 in the mill shell. The mill shell is surrounded by a stationary casing 55 from the bottom of which a chute 56 leads to an inlet end of an elevator 57. The outlet end of this elevator is connected to an air separator 58 by means of a chute 59. The bottom of the air separator 58 is connected by a gas conduit 60 to the casing 55. From the top of the air separator 58, a conduit 61 leads to a cyclone 62. In turn, another conduit 63 passes from the top of the cyclone 62 to a fan and is followed by an electrostatic precipitator (not shown). A worm conveyor 64 is provided at the bottom of the cyclone 62.

The coarse fraction from the air separator 58 is passed through a pipe 65 to a vibratory screen 66 from which the coarse fraction via a hopper 67, a worm conveyor 68, and a chute 69 is fed to the inlet hopper 46 and into the drying chamber 41. The fine fraction from the screen 66 is led through a chute 70 to the inlet hopper 47 and into the final compartment 43. Inlet conduits 71 and 72 for hot air or gas are provided in the inlet hoppers 46 and 47. Moist material passes through pipe 73, hopper 46, and trunnion 44 into the compartment 41 where it is predried by the hot gases admitted through conduit 71. The predried material is transported through the diaphragm 48 into the grinding compartment 42 where it is preground and simultaneously further dried by the hot gas. The preground material leaves the compartment 42 through the sieving diaphragm 49, passes through the openings 54, chute 56, elevator 57, and chute 59 to the air separator 58. The gas passes from the compartment 42 through the diaphragm 49, the casing 55, and conduit 60 to the air separator 58. From conduit 72, another stream of hot gas passes through the final compartment 43, the sieving diaphragm 50, casing 55, and conduit 60 to the air separator 58. The material discharged by overflow from the final compartment 43 in the manner previously described passes through the openings 54, chute 56, elevators 57, and chute 59 to the air separator 58, i.e., together with the preground material.

From the air separator 58 finished ground material is carried away with the gas through the conduit 61 and is precipitated in the cyclone 62 from which it is taken away by the conveyor 64. The gas passes through the conduit 63 to the suction fan and electrostatic precipitator. The coarse fraction from the air separator 58 passes via the pipe 65 to the screen 66 from which the coarse fraction via the hopper 67, conveyor 68 and chute 69 is returned to the drying compartment 41. The fine fraction from the screen 66 passes through the pipe 70 and hopper 47 to the final compartment 43 and is ground in this compartment by means of grinding bodies having an average piece weight below 10 grams, preferably about 5 grams, depending on the grindability of the material and the particle size at which the fractioning takes place in the screen 66. In order to avoid accumulation of oversize particles in the final compartment 43, the openings in the screen 66 are made smaller than the openings in the sieving diaphragm 50. The latter openings are preferably about 2 to 4 mm or even smaller.

The grinding bodies used in the compartment 42 may have an average piece weight of about 1500 grams. The mill shown in FIG. 4 may also be provided, if desired, with two preceding compartments.

Figure 5:
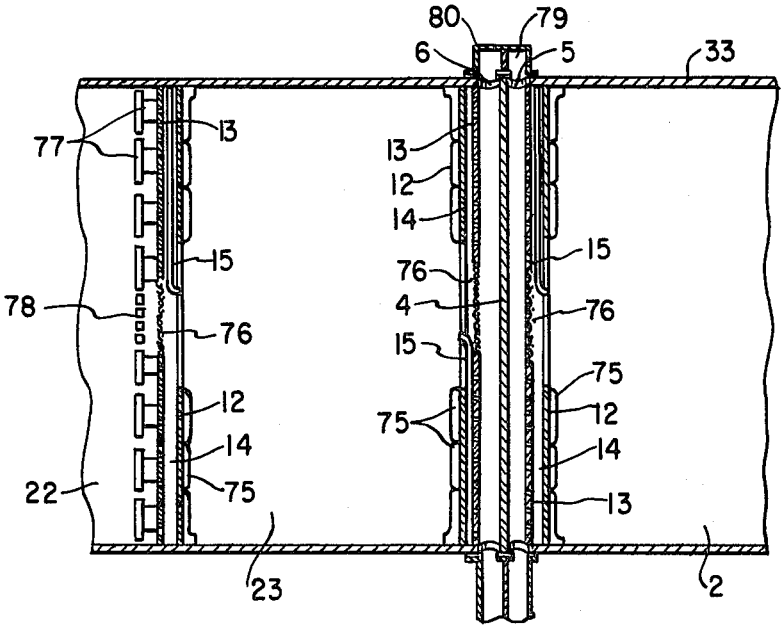
FIG. 5 is a partial enlarged view of the tube mill of FIG. 3.

According to FIG. 5, the dam rings 12 in both the grinding compartments 2 and 23 are protected by heavy wear plates 75 which are normally made from a special steel alloy. The sieving diaphragms 13 in each compartment are thus protected against wear from the grinding charges in the chambers and are relieved of the pressure from the charges. Thus, small grinding bodies flowing with the material into the chambers 14 are not pressed into the openings of the respective diaphragm 13, which otherwise would have a clogging effect.

Usually, one tube like lifting member 15 in each chamber 14 is sufficient to return small grinding bodies from the chambers to the grinding compartments 2, 23.

The sieving diaphragm 13 may be made of perforated steel plates supported in a light frame fastened to the mill shell. The central parts 76 of the diaphragms 13 may be made of wire mesh.

The diaphragm between the compartments 22 and 23 preferably consists of a wear resistant central grate 78 surrounded by heavy wear plates 77 spaced apart to form a coarse screen which retains the grinding bodies in the compartment 22. Lifters (not shown) are normally provided in the space between this coarse screen and the sieving diaphragm 13 for returning any coarse particles to the compartment 22.

FIG. 5 shows stationary outlet casings 79 and 80 for the material discharged through the openings 5 and 6 in the mill shell.

Figure 6:
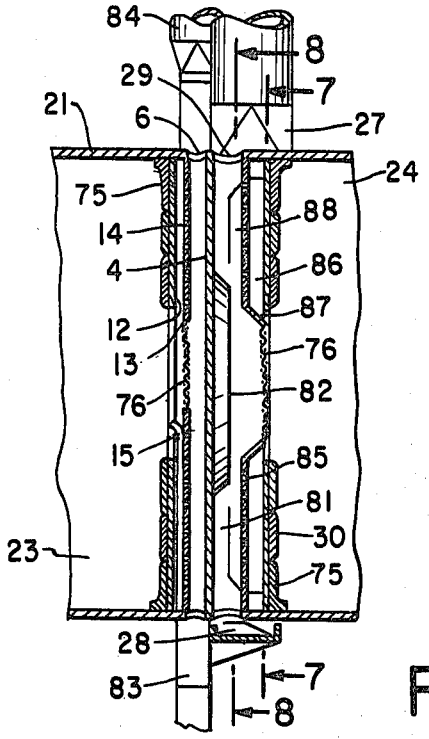
FIG. 6 is an enlarged view of a portion of the tube mill of FIG. 2.
Figure 7:
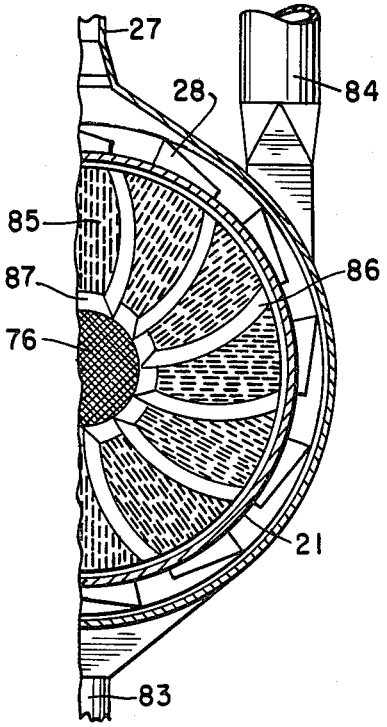
Figure 8:
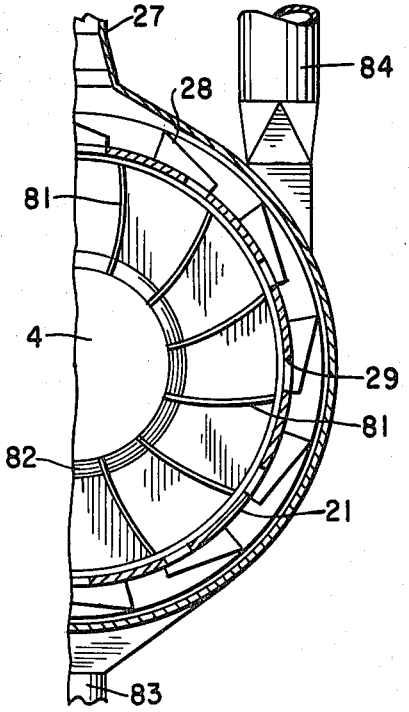
Figure 9:
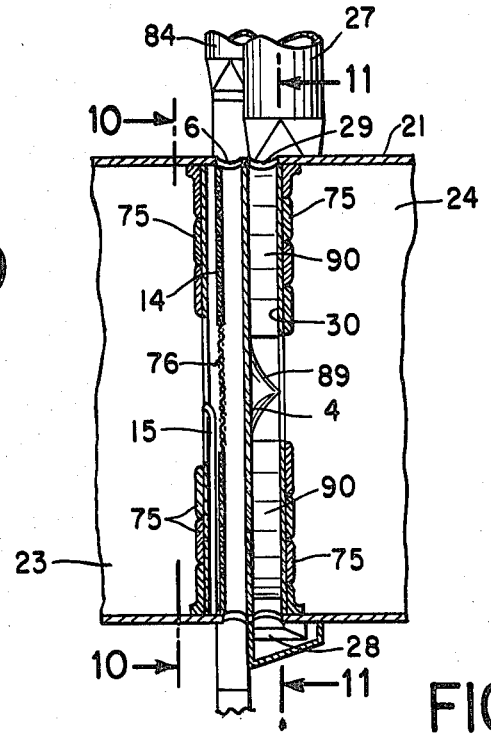
Figure 10:
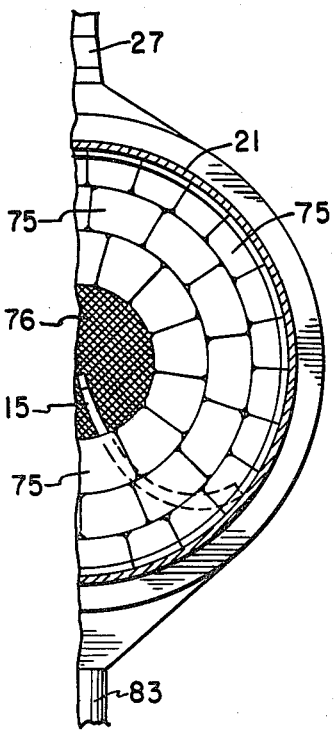

FIGS. 6 to 8 show scoops 28 mounted on the mill shell and communicating with the openings 29 in the mill shell. At the inlet end of the final compartment 24, and connected to the soild wall 4 and a cone 82 on same, scoops 81 are provided which open into a chamber 88, the downstream wall of which is formed by a sieving FIG. 7 is a cross-sectional view taken along line 7—7 of FIG. 6;

FIG. 8 is a cross-sectional view taken along line 8—8 of FIG. 6;

FIG. 9 is an enlarged view of modification of the tube mill shown in FIGS. 6 to 8;

FIG. 10 is a cross-sectional view taken along line 10—10 of FIG. 9; and

Figure 11:
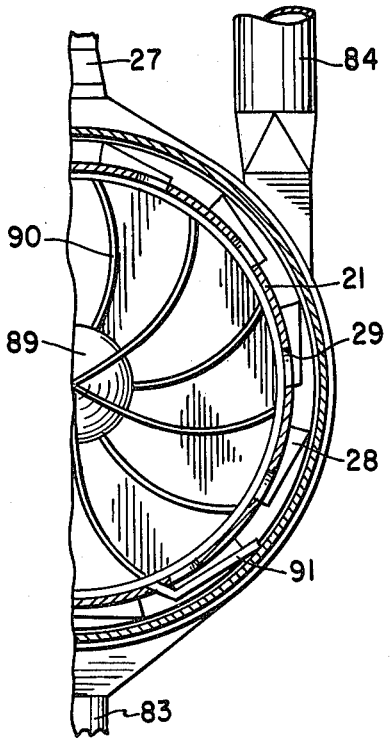

FIG. 11 is a cross-sectional view taken along line 11—11 of FIG. 9.

BEST MODE FOR CARRYING OUT THE INVENTION

FIG. 1 shows a tube mill 1 having a final grinding compartment 2 and a preceding pregrinding compartment 3. These two compartments are separated by a solid wall 4. The final compartment 2 has outlet openings 5 in the mill shell and the compartment 3 has outlet openings 6 in the mill shell. The mill has trunnions 7 and 8. A vibratory sieve 9 is provided outside the mill 1. A conveyor 10 leads from a vibratory sieve 9 to a trunnion 8 and another conveyor 11 leads to the trunnion 7. The final compartment 2 is provided at its outlet end with a dam ring 12 and a sieving diaphragm 13 spaced apart to form a chamber 14 in which there are provided lifting members 15 leading to the final compartment 2.

The material to be ground is fed to the compartment 3 through the trunnion 7 as indicated by arrow 16. This material is preground in the compartment 3 by means of grinding bodies preferably having an average piece weight of about 1,500 grams. Sufficiently preground material passes from the compartment 3 through slots in the sieving diaphragm 17 to the outlets 6. The slots in the sieving diaphragm preferably have a width of between about 6 to 8 millimeters.

An elevator 18 lifts the preground material from the outlets 6 to the sieve 9. The size of the openings in the sieving plate of the sieve 9 are chosen so that the fine fraction passing through the sieve 9 and fed, by the conveyor 10, to the final compartment 2 can be finished ground in one passage through this compartment by means of grinding bodies preferably having an average piece weight of, for example, about 5 grams. The openings of the sieve 9 can have maximum dimensions of 1 to 2 millimeters, depending on the grindability of the material.

The coarse fraction from the sieve 9 is fed to the preceding compartment 3 by means of the conveyor 11 and is then subjected to a renewed grinding in the compartment 3.

In the final compartment 2, the dam ring 12 ensures the correct ratio of grinding bodies and material to be ground. The finished ground material is discharged from the compartment by flowing over the dam ring 12. However, it is impossible to prevent a certain amount of the small grinding bodies from flowing over the dam ring 12 with the material. These grinding bodies would clog the openings in a sieving diaphragm 12 exposed directly to the pressure of the charge in the compartment. As is evident from FIG. 1, these grinding bodies are instead led to the sieving diaphragm 13 which is relieved from direct pressure by the dam ring 12. It is thereby possible to separate the bodies from the finished ground material without any clogging of the diaphragm 13 and to return the bodies to the compartment 2 by means of the lifting members 15 which will be described in more detail below. The openings in the relieved diaphragm 13 may be as small as 1 to 2 millimeters. The finished ground material leaving the openings 5 is carried away by a conveyor indicated by 19.

Figure 2:
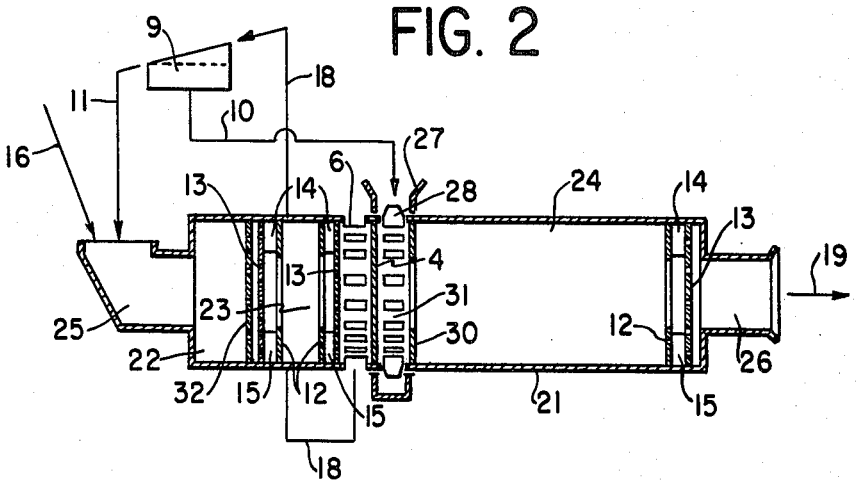
FIG. 2 is a schematic view of an alternate embodiment of the apparatus of the invention including a tube mill having two preceding and one final compartments.

The apparatus shown in FIG. 2 comprises a tube mill 21 having two preceding compartments 22 and 23 and a final compartment 24. The mill 21 has trunnions 25 and 26. The conveyor 11 from the sieve 9 leads to the trunnion 25 and the conveyor 10 leads to a stationary housing 27 surrounding the mill 21. Dam rings 12 and sieving diaphragms 13 are provided at each end of the compartment 23 so as to form chambers 14 in which lifting members 15 are provided. Similarly, at the outlet end of the final compartment 24, a dam ring 12, a sieving diaphragm 13, and lifting members 15 are provided in the chamber 14.

The final compartment 24 is provided with scoops 28 communicating with openings 29 in the mill shell. A dam ring 30 together with the solid wall 4 forms an inlet chamber 31 to the final compartment 24.

The material to be ground is fed to the compartment 22 through the trunnion 25 as indicated by the arrow 16. In the compartment 22 this material is preground by means of grinding bodies having an average piece weight of, e.g., of 1,500 grams. Sufficiently preground material passes from the compartment 22 first through a heavy grate diaphragm 32, and then through a sieving diaphragm 13 having openings of about 5 to 6 mm. Further, the material passes through the chamber 14 having lifting members 15 and over the dam ring 12 into the compartment 23 where it is further preground by means of grinding bodies having an average piece weight, e.g., of 5 grams. The preground material passes out of the compartment 23 over the dam ring 12 via the chamber 14 having lifting members 15 and through the sieving diaphragm 13 at the outlet end of the compartment 23. The outlet sieving diaphragm 13 has openings of the same size as that of the inlet sieving diaphragm 13 of the compartment 23 so that an accumulation of oversize unground particles will not take place in the compartment. Such particles will be returned to the compartment 22 via the sieve 9 as explained in connection with FIG. 1.

The fine fraction from the sieve 9 is passed to the inlet housing 27 by means of the conveyor 10 and is fed into the final compartment 24 by the scoops 28. Due to the adjustment of the openings in the sieve 9 this fine fraction can be finished ground in one passage through the final compartment 24 by means of grinding bodies having an average piece weight, e.g., of 5 grams or even as small as 1 gram depending on the particle size fractioning of the sieve 9. The finished ground material is discharged by overflow through the trunnion 26 via dam ring 12, chamber 14 having lifting members 15, and the sieving diaphragm 13 which has openings of the order of 2 to 4 mm.

In the apparatus shown in FIG. 2, the aim is to move as much of the grinding work as possible from the compartment 22 to the compartments 23 and 24. Thus, the length of the compartment 22 which has the lowest grinding economy is shortened.

Figure 3:
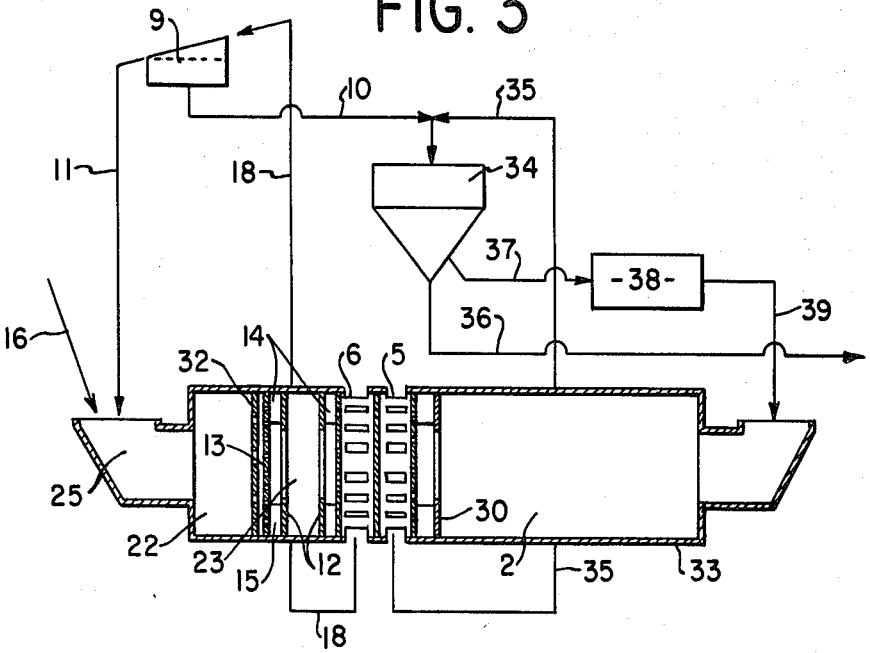
FIG. 3 is a schematic view of a third embodiment of the apparatus of the invention including a tube mill and a separator.

The apparatus shown in FIG. 3 comprises a tube mill 33 having two pregrinding compartments 22 and 23 similar to those shown in FIG. 2, and a final grinding compartment 2 similar to that shown in FIG. 1. The material discharged from the compartment 23 is taken to the sieve 9 by the conveyor 18. The coarse fraction from the sieve 9 is fed to the compartment 22 by the conveyor 11, whereas the fine fraction from the sieve 9 is taken by the conveyor 10 to an air separator 34. The diaphragm 85 and a cone 87. A dam ring 30 with wear plates 75 is spaced apart from the diaphragm 85 to form another chamber in which a second set of scoops 86 is mounted. These scoops 86 open into the final compartment 24.

A stationary casing 83 surrounding the mill shell receives the material discharged from the compartment 23. At the top of this casing 83 an outlet conduit 84 is provided for the discharge of any air or gas led through the preceding chambers 22 (FIG. 2) and 23.

The material from the conveyor 10, illustrated in FIG. 2, is delivered into the casing 27 and is shovelled into the chamber 88 by the scoops 81. From the chamber 88 the material passes through the diaphragm 85 to the next chamber provided with the scoops 86 which deliver the material into the final compartment 24. The scoops 86 also return small grinding bodies which have passed over the dam ring 12 into the chamber containing the scoops 86. The openings in the diaphragm 85 are small enough to prevent the passage of the small grinding bodies but large enough to allow the material to be fed to the final compartment to pass through. Therefore, the particle size fractioning limit of the sieve 9 (FIG. 2) and the size of the small grinding bodies are adjusted in accordance with this requirement.

In the tube mill shown in FIGS. 9 to 11, a dam ring 30 having wear plates 75 is positioned apart from the solid wall 4 so as to form an inlet chamber in which are mounted scoops 90, the outer ends of which follow a cone 89. Besides the scoops 28 an additional scoop 91 is mounted on the mill shell. This scoop 91 projects close to the wall of the stationary casing 27 as can be seen in FIG. 11.

FIG. 10 shows that the lifting member 15 for returning small grinding bodies to the compartment 23 is formed as a spiral. The material is fed tangentially into the casing 27 through a pipe 92 and against the direction of rotation of the mill and is caught by the scoops 28 which lead the material to the scoops 90. These scoops deliver the material into the final compartment 24. Any small grinding bodies which pass over the dam ring 30 into the casing 27 accumulate at the bottom of the casing beyond the path of the scoops 28 and are returned to the final compartment 24 by means of the scoop 91.

We claim:

1. A method of dry grinding granular material in a grinding tube mill having a final and at least one preceding grinding compartment containing grinding bodies, comprising directing the material to the tube mill, grinding the material in the preceding compartment, discharging the preground material from the preceding compartment through openings in the mill, dividing the preground material into fine and coarse fractions by a separation process, returning the coarse fraction to the preceding compartment, directing the fine fraction to the final compartment for grinding therein, discharging the ground material from the final compartment together with any grinding bodies carried therewith, separating the grinding bodies from the material discharged from the final compartment in the tube mill proper, and returning the grinding bodies to the final compartment.

2. The method according to claim 1, wherein the material is ground in the preceding grinding compartment with grinding bodies having an average piece weight of less than about 10 grams.

3. The method according to claim 2 wherein the maximum size of particles fed to the preceding compartment is equal to or below the width of the openings in an outlet sieve diaphragm of the compartment.

4. The method according to claim 3 including the step of cooling the fine fraction before being fed to the final grinding compartment.

5. The method according to claim 4 including drying the material to be ground simultaneously with the grinding or separation of the material by means of hot gases brought in to contact with the material.

6. The method according to claim 4 including drying the material to be ground simultaneously with the grinding and separation of the material by means of hot gases brought into contact with the material.

7. The method according to any of claims 6 or 5 including removing finished ground material from the material discharged from the preceding compartment before being subjected to the separation process.

8. The method according to claim 7 wherein the final grinding compartment is coupled to particle separator means for precipitating finished ground material.

9. The method according to claim 8 wherein dividing the material includes separating the coarse and fine fractions at such a particle size so as to permit feeding the fine fraction to the final grinding compartment and obtaining finished ground material in one passage through the final compartment.

10. The method according to claim 9 including grinding the material in the final compartment with grinding bodies having an average piece weight less than about 10 grams.

11. The method according to claim 10 wherein the material is ground in the final compartment with grinding bodies having an average piece weight of about 5 grams.

12. The method according to claim 11 wherein the final grinding compartment is operated in closed circuit with separator means including at least one cyclone separator for precipitating finished ground material.

13. A method of dry grinding granular material to a finished ground material in a grinding tube mill, the tube mill having at least one opening, a final grinding compartment and at least one preceding grinding compartment containing grinding bodies, at least one preceding grinding compartment having an outlet sieving diaphragm, comprising the steps of passing the material through the preceding compartment, discharging the preground material through the openings in the tube mill, dividing the preground material into predetermined fine and coarse fractions, returning the coarse fraction to the preceding compartment, feeding the fine fraction to the final compartment for grinding therein, discharging the ground material by overflow from the final compartment, separating the grinding bodies carried with the overflowing ground material in the tube mill proper and returning the grinding bodies to the final compartment.

14. An apparatus for dry grinding granular material comprising a grinding tube mill divided into a final and at least one preceding grinding compartment containing grinding bodies, the mill being provided with openings through which material may be discharged from the preceding compartment, means for separating the material discharged from the mill openings into coarse and fine fractions, means to convey material discharged from the mill openings to said separator means and to convey the coarse fraction from the separator means to the feed end of the preceding compartment and the fine fraction to the feed end of the final compartment, at least one dam ring and sieving diaphragm positioned in the outlet end portion of the final compartment, the dam ring relieving the pressure of the mill charge, the sieving diaphragm being spaced apart from the dam ring to form a chamber and defining openings smaller than the size of the grinding bodies in the final compartment, lifting means provided in said chamber to return to the final compartment the grinding bodies that in use, pass over the dam ring with the ground material.

15. An apparatus for dry grinding a granular material comprising a grinding tube mill having a final grinding compartment and at least one preceding grinding compartment, having grinding bodies disposed therein and inlet and outlet end, the tube mill having at least one opening for the discharge of material from the preceding compartment, means for separating the material into coarse and fine fractions, first means for conveying material discharged from the mill opening to the separating means, second means for conveying the coarse fraction from the separating means to the inlet end of the preceding compartment, and third means for conveying the fine fraction to the feed end of the final compartment, the outlet end portion of the final compartment having a dam ring and a sieving diaphragm having openings dimensioned less than the size of the grinding bodies therein and spaced apart from the dam ring to define a chamber therebetween, the dam ring relieving the pressure of the mill charge, lifting means disposed in said chamber for lifting and returning grinding bodies passing into the chamber with the ground material to the final grinding compartment.

16. The apparatus according to claim 15 wherein at least one preceding compartment includes grinding bodies having an average piece weight of approximately 10 grams or less and a dam ring and a sieving diaphragm are disposed at each of its inlet and outlet ends, the sieving diaphragm being spaced apart from the dam ring to define a chamber therebetween, the chamber having means for returning grinding bodies passing over the dam ring, and the diaphragms at the inlet and outlet ends defining openings of substantially the same size, said openings being smaller than the size of the grinding bodies in said compartment.

17. The apparatus according to claim 15 or 16 wherein the final grinding compartment includes a feed inlet chamber which communicates with the openings in the mill and which comprises a dam ring and lifting means for feeding the material into the compartment and for returning grinding bodies from the chamber to the compartment.

18. The apparatus according to claim 17 further comprising a sieving diaphragm disposed adjacent the inlet end of the final compartment.

19. The apparatus according to claim 18 further comprising a preliminary separator for precipitating finished ground material, a final separator for separating the material into coarse and fine fractions, fourth conveying means for conveying material from the outlet ends of the final grinding compartment and the preceding grinding compartment to the preliminary separator, and fifth conveying means for conveying the non-precipitated material from the preliminary separator to the final separator.

20. The apparatus according to claim 19 wherein the separator from which the fine fraction is fed to the final grinding compartment comprises a vibratory screen.

21. The apparatus according to claim 20 further comprising means for cooling the material fed to the final grinding compartment.

22. The apparatus according to claim 21 wherein the grinding bodies in the final grinding compartment are of an average piece weight of not greater than 10 grams.

23. The apparatus according to claim 22 wherein the grinding bodies in the final grinding compartment are of an average piece weight of about 5 grams or less.

24. The apparatus according to claim 23 wherein the width of the openings in the diaphragm is about between 2 and 5 millimeters.

25. An apparatus for dry grinding a granular material, comprising a grinding tube mill having a final grinding compartment and at least one preceding grinding compartment having an inlet and an outlet end, and grinding bodies disposed therein, the tube mill having at least one opening for the discharge of material from said at least one preceding compartment, a separator for separating the material into coarse and fine fractions, means for conveying material discharged from the mill opening to the separator and for conveying the coarse fraction from the separator to the inlet of said at least one preceding compartment and for conveying the fine fraction to the feed inlet end of said final compartment, the outlet end portion of said final compartment having a dam ring and a sieving diaphragm spaced apart therefrom and having a plurality of openings, the dam ring relieving the pressure of the mill charge, the dam ring and sieving diaphragm defining a chamber therebetween having means disposed in said chamber for lifting the grinding bodies passing into said chamber with the ground material and returning the grinding bodies to said final grinding compartment for final grinding, the grinding bodies in said at least one preceding grinding compartment having an average piece weight being not greater than 10 grams and the openings of the diaphragm in said at least one preceding grinding compartment being dimensioned less than the corresponding grinding bodies, the grinding bodies in said final grinding compartment having an average piece weight less than the average piece weight of the grinding bodies in said at least one preceding compartment and the openings of the diaphragm in said final grinding compartment being dimensioned less than the corresponding grinding bodies.

26. The apparatus according to claim 25 further comprising means for drying by hot gases, the material in said at least one preceding grinding compartment simultaneously while being ground in said compartment.

27. The apparatus according to claim 26 wherein at least one preceding grinding compartment at its inlet and outlet ends is provided with a dam ring and a sieving diaphragm spaced apart to form a chamber from which grinding bodies that pass over the dam ring are returned to said compartment by lifting means provided in the said chamber, the diaphragms at the said inlet and outlet ends having openings of the same size, said openings being dimensioned from approximately 2 to 5 mm and being smaller than the size of the said grinding bodies therein.

28. The apparatus according to claim 27 wherein a cooler is provided in the path of conveyance for the material being fed to the final grinding compartment.

29. An apparatus for dry grinding granular material comprising a grinding tube mill divided into a final and at least one preceding grinding compartment containing grinding bodies, the mill being provided with openings through which material may be discharged from the preceding compartment, means for separating the material discharged from the mill openings into coarse and fine fractions, means to convey material discharged from the mill openings to said separator means and to convey the coarse fraction from the separator means to the feed end of the preceding compartment nd the fine fraction to the feed end of the final compartment, at least one dam ring and sieving diaphragm positioned in the outlet end portion of the final compartment, the dam ring relieving the pressure of the mill charge, the sieving diaphragm being spaced apart from the dam ring to form a chamber and defining openings smaller than the size of the grinding bodies in the final compartment, lifting means provided in said chamber to return to the final compartment the grinding bodies that in use, pass over the dam ring with the ground material, the grinding bodies in said at least one preceding grinding compartment having an average piece weight of approximately equal to or less than 10 grams and the openings of the diaphragm in said at least one preceding grinding compartment being dimensioned less than the corresponding grinding bodies, the grinding bodies in said final grinding compartment having an average piece weight less than the average piece weight of the grinding bodies in said at least one preceding compartment and the openings of the diaphragm in said final grinding compartment being dimensioned less than the corresponding grinding bodies.

* * * * *